United States Patent [19]

Bonora et al.

[11] 4,194,324

[45] Mar. 25, 1980

[54] SEMICONDUCTOR WAFER POLISHING MACHINE AND WAFER CARRIER THEREFOR

[75] Inventors: Anthony C. Bonora, Atherton; Karl Lorenz, Redwood City, both of Calif.

[73] Assignee: Siltec Corporation, Menlo Park, Calif.

[21] Appl. No.: 869,652

[22] Filed: Jan. 16, 1978

[51] Int. Cl.[2] ..... B24B 29/00

[52] U.S. Cl. ..... 51/131.5; 51/235; 269/21; 279/3

[58] Field of Search ..... 51/131 R, 131 A, 131 B, 51/131 C, 131 D, 216 R, 216 LP, 216 T, 235; 269/21; 279/3

[56] References Cited

U.S. PATENT DOCUMENTS

| | | | |
|---|---|---|---|
| 1,520,766 | 12/1924 | Oakes | 51/131 B |
| 2,366,935 | 1/1945 | Schmid | 51/235 |
| 3,559,346 | 2/1971 | Paola | 51/131 C X |
| 3,603,042 | 9/1971 | Boettcher | 51/131 C |
| 3,747,282 | 7/1973 | Katzke | 269/21 X |
| 3,886,696 | 6/1975 | Bruck | 51/216 LP |
| 4,049,484 | 9/1977 | Priest et al. | 269/21 X |

*Primary Examiner*—Harold D. Whitehead

*Assistant Examiner*—Robert P. Olszewski

*Attorney, Agent, or Firm*—C. Michael Zimmerman

[57] ABSTRACT

A carrier for semiconductor wafers to be polished is described, as well as mounting structure for securing the carrier within a polishing machine. The carrier is a relatively thick metal plate having on one of its faces, a sheet of material to which wafers can be adhered. An annular flange is on its opposite face to receive pressure loading from the polishing machine during the wafer polishing operation. Radially extending webs connect the annular flange with that area of the plate to distribute the pressure loading over substantially the full area of the plate opposed to the area on the opposite face on which wafers are to be adhered. An arrangement is included in the holder of the polishing machine for the carrier which applies a vacuum to the carrier to maintain the carrier selectively on the polishing machine, which arrangement releases the vacuum during the polishing operation and also enables simple intentional removal of the carrier. The carrier holder also enables the orientation of the carrier relative to the remainder of the polishing machine to be angularly tilted in such a manner that the leverage of any tangential force applied to wafers being polished is minimized.

11 Claims, 7 Drawing Figures sheet 24 of wafer mounting material interposed between the plate and wafers most desirably provides thermal insulation, some heat is bound to reach the plate 22. Such plate is thermally conductive and transmits such heat to the webs 27 on the side 25. The web fins provide an extended surface area for transmitting such heat to the ambient atmosphere by both radiation and convection. In the preferred embodiment, such fins are aluminum and are most desirably cast integrally with the plate 22 and the flange 26 to assure good thermal conductivity, as well as structural rigidity.

Figure 1:
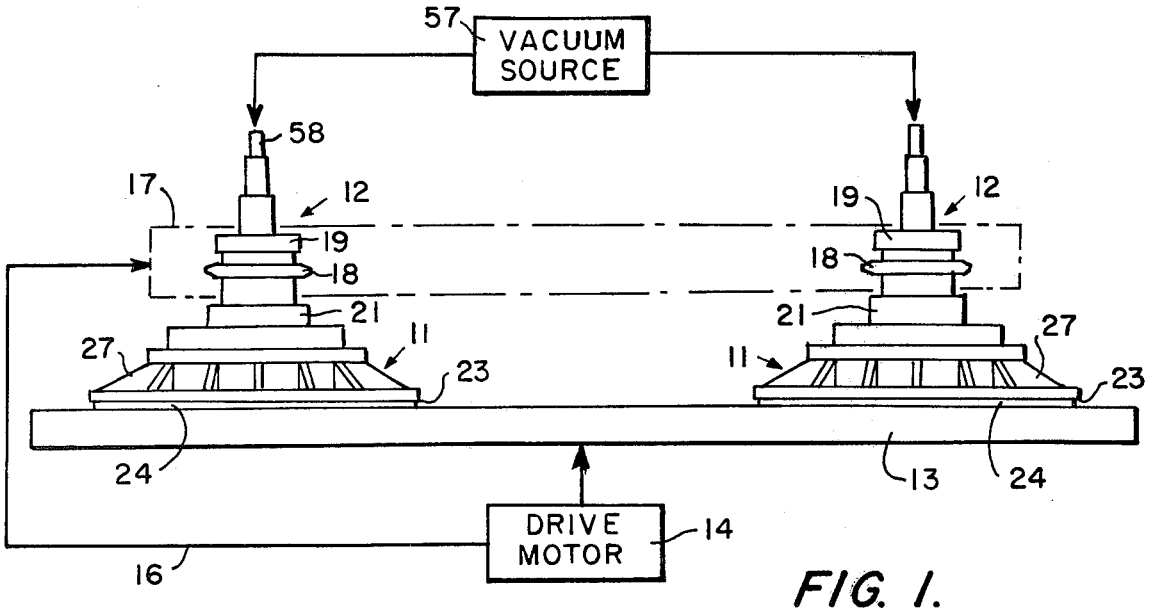
Figure 2:
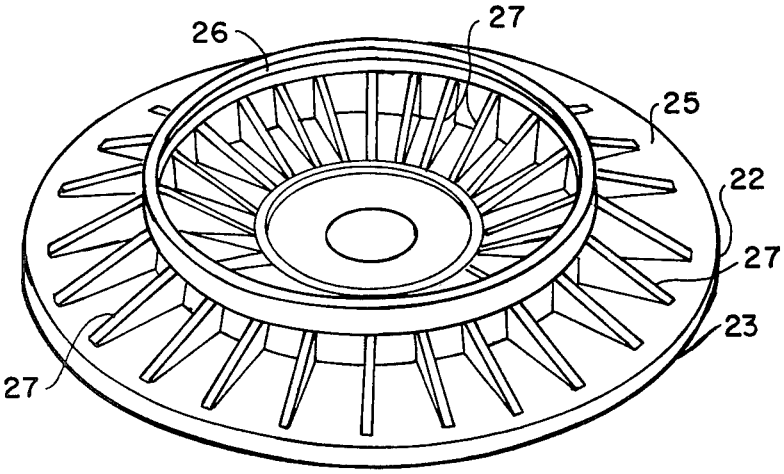

While pressure loading for the polishing operation is transmitted to the carrier via flange 26, as discussed previously, any tangential forces to which the carrier is subjected during the polishing operation are transmitted to the polishing machine via engagement of an annular flange 30 on the carrier with a cylindrical side surface of a central projection on a carrier mounting head 29. As can be seen from FIGS. 3A and 3B, the place of engagement of flange 30 with the head 29 is spaced closely adjacent to the plate 22 so that such tangential forces will have minimum leverage on the carrier.

The structure for mounting the carrier on the polishing machine is designed to transmit desired rotation thereto, while reducing the likelihood that the carrier or the wafers will be distorted when subjected to tangential forces during the polishing operation. Such structure includes for each carrier a drive spindle 28 journalled for rotation within the bearings 19 and 21. Spindle 28 rotatably drives head 29 of the carrier in a manner to be described in more detail below, which head, in turn, rotatably drives carrier 11.

Rotary motion is transmitted to the spindle 28 of each of the holders via its sprocket 18. That is, such sprocket is connected to the spindle through a slip clutch provided by friction discs 31, friction ring 32, and a clutch adjustment nut 33. The friction ring 32 and clutch adjustment nut 33 are connected to the spindle 28 by set screws 34 in order to impart their rotation to the spindle. The friction ring set screw, however, engages the spindle in a vertical slot so that limited vertical motion between the ring and spindle is permitted. This permits operation of the slip clutch arrangement, as well as adjustment of the torque required for slippage. In this connection, a Belleville spring 36 urges the ring 32 upward and, hence, places the sprocket 18 in compression between friction discs 31. The degree of compression can be adjusted by changing the vertical location of the nut 33 on the spindle 28.

The purpose of the slip clutch arrangement is to assure that blockage of the rotation of the carrier holder will not cause damage to the polisher drive mechanism. It should be adjusted to enable slippage when blockage occurs, but to assure otherwise non-slipping drive of the spindle by the sprocket.

Rotation of the spindle 28 is imparted through a driving disc 37 (FIGS. 3A and 4) to a ring drive 38. In this connection, driving disc 37 is rigidly secured to the spindle 28 adjacent the lower end of the latter for rotation therewith. It is connected to the ring drive 38 via a diaphragm 39, a thin annular plate of metal. That is, diaphragm 39 is secured about its full outer periphery to the disc drive 37, and to the ring drive 38 at two locations 180° apart on its inner periphery.

Figure 4:
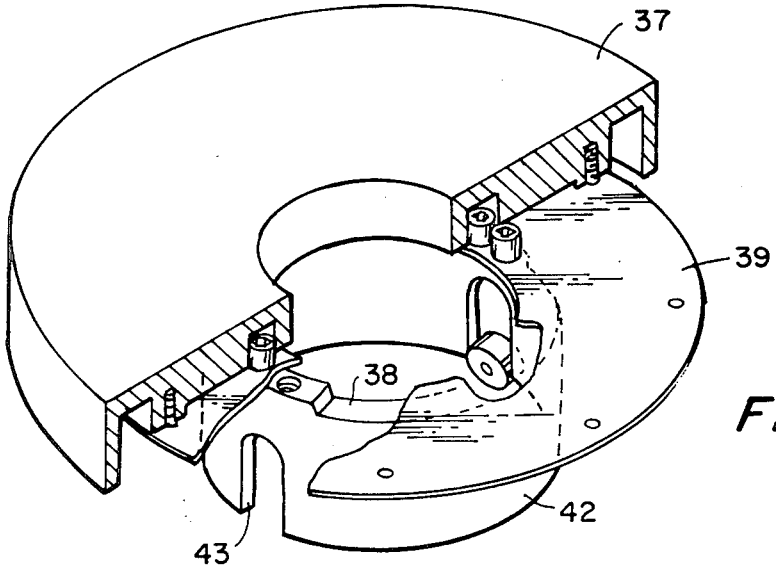
Figure 3A:
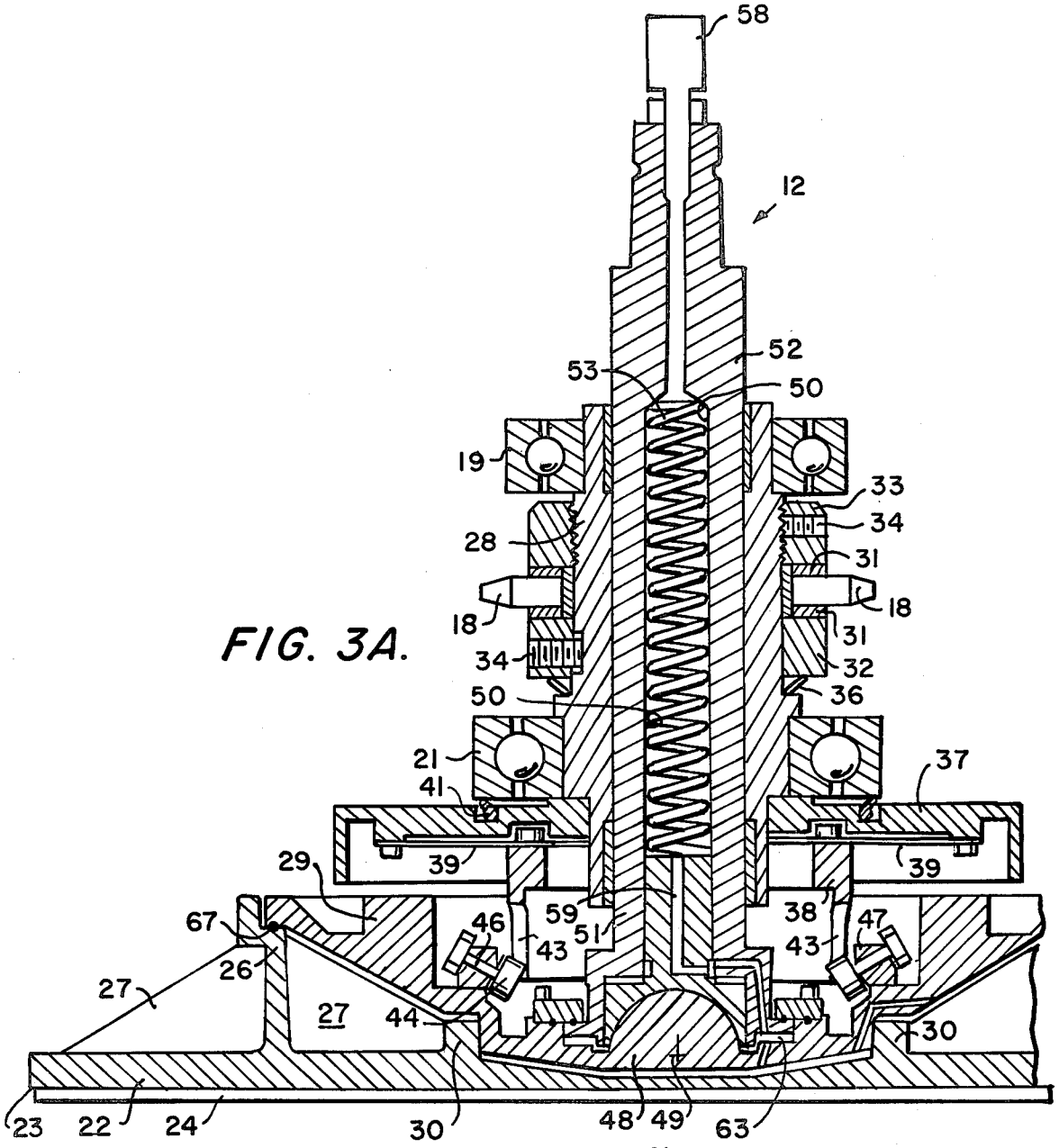

As best illustrated in FIGS. 3A and 4, the bottom surface of the disc drive 37 is relieved adjacent the diaphragm 39 and the cap screws which secure the same to the ring drive 38. The result is that slight flexure of the plate in the vertical direction will be permitted. However, the rotational forces applied to the diaphragm by the disc drive will be in the plane of such diaphragm, with the result that the diaphragm will transmit such forces to the ring drive in a positive manner. As illustrated, an annular felt or rubber ring seal 41 is positioned within an annular groove in the upper surface of the disc drive and engages the outer race of the bearing 21. The purpose of such seal is to inhibit particulate contamination of the bearing.

Rotation of ring drive 38 is imparted to the previously mentioned carrier head 29 in a manner which enables the orientation of the head and, hence, of the carrier, to be angularly tilted. To this end, ring 38 includes a depending skirt 42 (FIGS. 3A and 4) which has a pair of vertical slots 43 at diametrically opposite locations. Cam followers associated with the head ride within such slots. That is, the lower end of each of the slots is open and receives a cylindrical cam follower 44 rotatably secured on the lower end of an axle 46 journalled for rotation within a block 47 which projects upward from a shelf within the interior of the head 29.

Each of the slots 43 has a width only slightly greater than the diameter of its associated cam follower 44. Rotation of the ring drive 38 will thus be transferred to the head 29 via engagement of such cam followers with the side walls of the slots. However, tilting motion of the head 29 and, hence, of the carrier, will be accommodated. That is, the cam follower-slot arrangement permits tilting in the plane containing the axles 46 of the cam followers. Flexure of the diaphragm 39 in a direction orthogonal to such plane accommodates any tilting component which is not in such plane. In this connection, it should be noted that the diametrically opposed connections between the plate 39 and the ring drive are in vertical alignment with the slots 43 (FIG. 4), and the plate is otherwise free from connection to the ring drive to permit such flexure.

As mentioned previously, while it is necessary to accommodate slight angular tilting of a wafer carrier so that it can mate parallelly with the polishing pad, tilting develops tangential forces at the carrier face-polishing pad interface which deleteriously affect the flatness of wafers being polished. As a particularly salient feature of the instant invention, it includes a joint arrangement which substantially eliminates this problem. While a ball and socket joint is included in the construction, as in the past, to permit the tilting motion, it is so arranged that the leverage of any tangential forces tending to cause unwanted tilting of the carrier are minimized. To this end, the ball 48 of the joint projects away from the side 25 of the carrier 11 rather than toward the same as in previous construction known to applicants. The side 25 is the side of the carrier opposite the face to which wafers are adhered, and the center of rotation of the joint, i.e., the center of the ball 48 is therefore positionable closely adjacent to such face. The leverage arm of any forces projecting tangentially along the face to the center of the joint can thus be significantly shortened. It should be noted that the center 49 of the ball 48 is positioned at the intersection of the axes of axles 46.

Figure 3B:
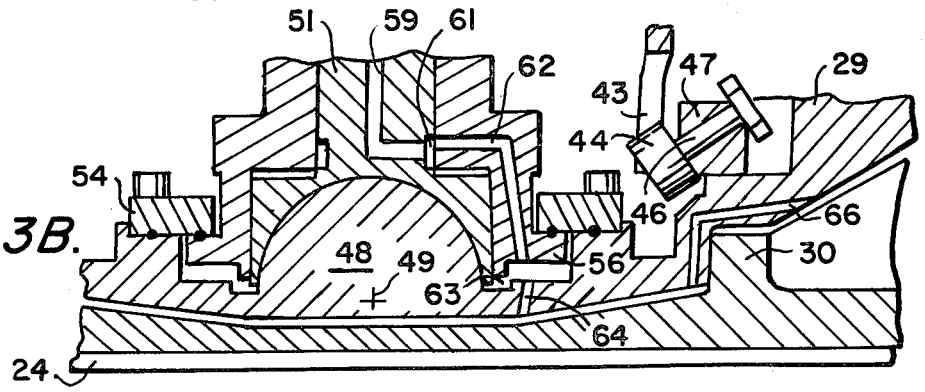

As can be seen from FIGS. 3A and 3B, the carrier plate 22 is of reduced thickness adjacent its center to permit the center 49 of the ball to be positioned, as described, closely adjacent the carrier wafer face. It should be remembered that wafers are not adhered to such face adjacent to its center during the polishing operation, so that the distortions which may be experienced at such location due to the thinness of the plate at such location can be tolerated.

The socket of the ball and socket joint is provided as a cavity within the lower end of a plug 51 which is slidably received within an axial bore 50 of a central shaft 52 about which the spindle 28 is journalled for rotation. Plug 51 is of a low friction material, such as one of the hard, high molecular weight plastics which are available, and is normally urged downward with respect to the shaft 52 by a coil spring 53 maintained in compression between the plug and the upper end of the bore 50.

The downward pressure on plug 51 provided by spring 53 results in the head normally being maintained level, i.e., orthogonal to the axis of the shaft 52. That is, the downward pressure urges the plug against the ball 48, which ball is part of the head. The head is accordingly urged downwardly. The result is that a leveling ring 54 rigidly secured to the head surrounding the lower end of the shaft 52 engages an annular flange 56 extending radially outward from the lower end of the shaft 52. This engagement of the ring 54 with the shaft flange 56 results not only in the head being secured to the remainder of the structure, but also in the head being maintained in a plane parallel to the plane defined by the flange 56. Such flange is made orthogonal to the axis of the shaft 52 so that the head and carrier are therefore normally held level.

A simple vacuum arrangement is used to maintain the carrier 11 on the head 29. A vacuum source 57 (FIG. 1) communicates through a rotary union 58 (schematically represented) with the shaft bore 50. A passage 59 through the plug 51 communicates the bore with an annular groove 61 in the plug 51 at the bottom of bore 50. As best shown in FIG. 3B, groove 61 is, in turn, communicated with a passage 62 which extends through the shaft 52 to an annular space 63 surrounding the ball and socket joint. The space 63 communicates via a short passage 64 with the head-carrier plate interface.

As illustrated, the central portion of the head-carrier interface is communicated around the previously mentioned annular flange 30 to the remainder of the interface via a passage 66 through the head. Moreover, an O-ring seal 67 is provided adjacent the peripheral edge of the head at the location it transmits pressure loading to the flange 26 of the carrier.

The structure of the carrier inwardly of the seal 67 is impermeable to air, and the O-ring seal 67 provides a hermetic engagement of the same with the head surface. The result is that the application of vacuum to the interface of the head surface and the carrier side as described will result in the carrier being adhered to the carrier holder. That is, the relatively large interface area between the holder and the carrier will result in significant force being applied to the carrier tending to maintain it on the holder head even when the degree of vacuum which is applied to the interface is not significantly below atmospheric pressure.

Figure 5:
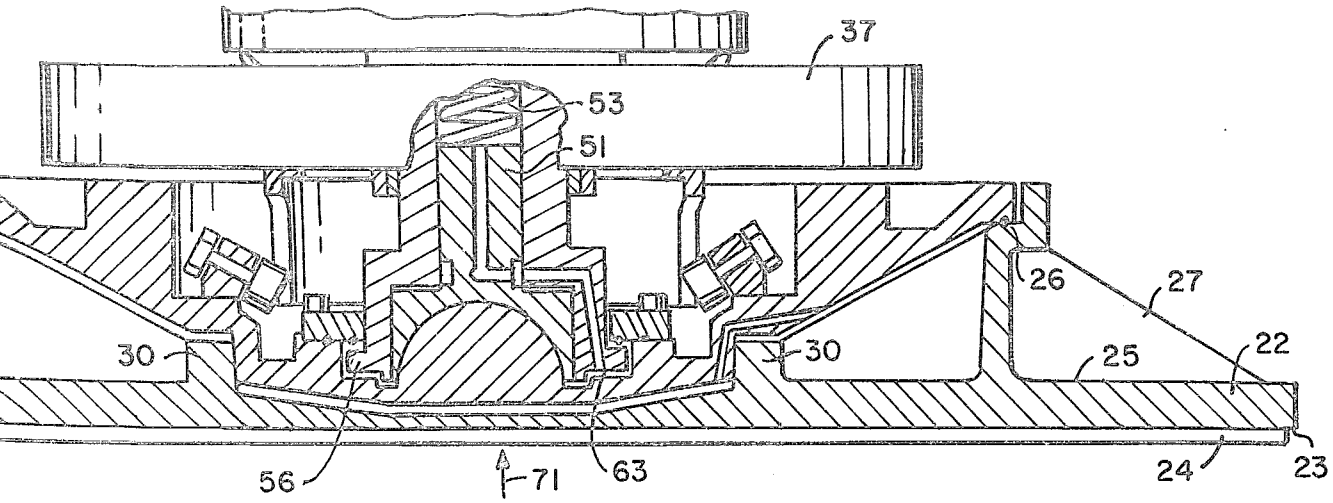

Even though the applied vacuum can be quite low, e.g., twelve p.s.i. below ambient, the pressure differential on opposite sides of the carrier can result in enough distortion of such carrier to deleteriously affect wafer flatness. In order to prevent such distortion, means are provided to release the application of the vacuum whenever wafers on the carrier are pressed against a polishing pad. That is, the force required to compress coil spring 53 is selected to be less than the upper force exerted on the carrier and carrier holder during the polishing operation. As illustrated in FIG. 5, the result will be that when polishing pressure, represented by arrow 71, is exerted against the carrier, the plug 51 will move upward within the shaft 52 and, thus, permit the leveling ring 54 secured to the head 29 to be lifted away from the sealing flange 56. This will open the annular space 63 to atmosphere and, thus, relieve the applicationn of vacuum to the carrier holder-carrier interface.

Figure 6:
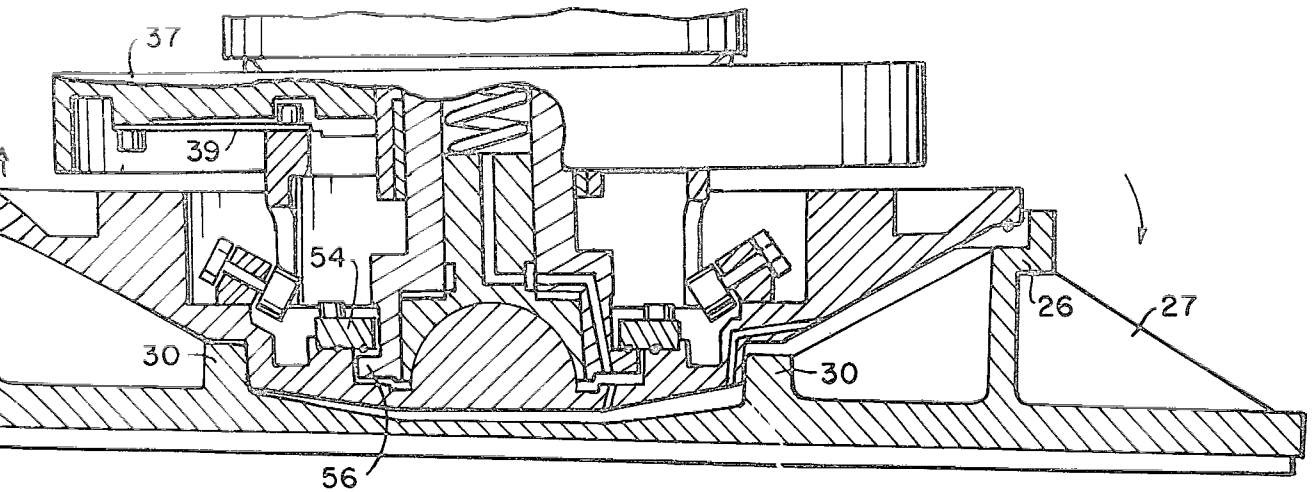

The construction is also designed to enable the carrier to be removed from the carrier holder in a quite simple manner without requiring disconnection of the polishing head from the source of vacuum. More particularly, as discussed previously, the diaphragm 39 and cam follower-ring construction permit slight angular tilting of the head of the carrier holder with respect to the remainder thereof. Thus, manual tilting of the same in, for example, the clockwise direction as viewed in FIG. 6, will result in the leveling ring 54 being raised somewhat from the flange 56 on the lefthand side of the shaft 52. This will break the vacuum seal between the leveling ring and the shaft flange and communicate the space 63 to the atmosphere, thus relieving the vacuum. It should be noted that this vacuum seal can also be broken by manually pushing the carrier holder inward against the force of spring 53.

It will therefore be seen that grasping and either manually tilting or moving the carrier upward with respect to the remainder of the apparatus will automatically result in the vacuum being released and enable the carrier to be removed. It should be noted that once the carrier is removed, the force of spring 53 will cause leveling ring 54 to again engage the flange 56 around the full periphery of the shaft so that the vacuum is again communicated through the passage 64 and another carrier can be simply attached to the holder head by placing it in position.

While the invention has been described in connection with a preferred embodiment thereof, it will be appreciated by those skilled in the art that various changes and modifications can be made. It is therefore intended that the coverage afforded application be limited only by the spirit of the invention as set forth in the claims.

We claim:

1. A carrier for thin wafers to be treated comprising:

A. a rigid plate;

B. means on a first face of said plate to adhere thereto one or more wafers to be treated;

C. load bearing means on the side of said plate opposed to said first face to receive loading to press wafers mounted on said first face against a treating means; and D. load distributing means on said side connecting said load bearing means with substantially the full area of said side opposed to that area of said first face to which wafers are to loading applied to said load bearing means is distributed over said full area;

E. said load bearing means comprising a flange projecting from said side generally centrally with respect to said full area and extending about a generally closed path thereon having a configuration generally the same as the configuration of the outer periphery of said full area, and said load distribution means includes a plurality of webs extending between said flange and said plate side both inwardly and outwardly of said generally closed path.

2. A carrier according to claim 1 combined with apparatus within which one or more thin wafers are to be held for treatment which includes means to mount said carrier to the remainder of said apparatus so as to enable the orientation of said carrier relative to said apparatus to be angularly tilted, said means including a ball and socket joint with the spherical portion of the ball thereof projecting away from said first face and the center of rotation of said joint positioned closely adjacent to said face so that the leverage of any forces projecting tangentially along said face and tending to tilt said carrier with respect to said apparatus is minimized.

3. A carrier according to claim 1 wherein said plate has an air impermeable second surface opposed to said first face and said carrier is combined with apparatus within which one or more thin wafers are to be held for treatment, which apparatus has means to mount said carrier to the remainder of said apparatus that includes:

A. a source of vacuum; and

B. a carrier holder providing a surface adapted to hermetically engage said second surface of said carrier and having a passage for communicating said source of vacuum with the interface of said holder surface and said carrier second surface to apply said vacuum thereto.

4. A carrier according to claim 3 further including means to release the application of vacuum to said interface whenever wafers mounted on said first face are pressed against said treatment means.

5. A carrier according to claim 3 further including means to release the application of vacuum to said interface upon said carrier being angularly tilted with respect to the remainder of said apparatus.

6. A carrier according to claim 1 wherein said plate is of a thermally conductive material and said webs extending outwardly of said flange act as heat dissipating fins to dissipate any heat conducted through said plate to said side.

7. A carrier according to claim 6 wherein said means to adhere one or more wafers to be treated to said first face of said plate includes a sheet of thermal insulating material interposed between said thermally conductive plate and the location at which wafers are to be positioned for treating.

8. A carrier according to claim 1 wherein said plate is a disc, said flange is annular, and said webs extend from said flange both radially inwardly and outwardly of said disc connecting said flange to said second face.

9. In apparatus within which one or more thin wafers are to be held for treatment:

A. a carrier having:

(1) a first face to which said wafers are to be adhered for said treatment;

(2) an air impermeable surface; and (3) load bearing means on the side of said plate opposed to said first face to receive loading to press wafers mounted on said first face against a treating means; and B. means to mount said carrier to remainder of said apparatus including:

(1) a source of vacuum;

(2) a carrier holder having a surface adapted to hermetically engage said second surface of said carrier and a passage to communicate said source of vacuum with the interface of said holder surface and said carrier surface to apply said vacuum thereto; and (3) means which responds automatically to the application of loading to said load bearing means to press wafers mounted on said first face against said treating means, by releasing the application of vacuum to said interface.

10. In apparatus according to claim 9 further including means to release the application of vacuum to said interface upon said carrier being angularly tilted with respect to the remainder of said apparatus.

11. A carrier according to claim 2 wherein said load bearing flange circumscribes said ball and socket joint.

* * * * *

United States Patent [19]

Chalpin, Jr.

[11] 4,194,325

[45] Mar. 25, 1980

[54] GUTTER SYSTEM FOR SKYLIGHTS OR THE LIKE

[75] Inventor: Stephen F. Chalpin, Jr., Overland Park, Kans.

[73] Assignee: Butler Manufacturing Company, Kansas City, Mo.

[21] Appl. No.: 950,709

[22] Filed: Oct. 12, 1978

[51] Int. Cl.[2] ..... E04D 13/00

[52] U.S. Cl. ..... 52/14; 52/126; 52/200

[58] Field of Search ..... 52/15, 14, 13, 11, 126, 52/200

[56] References Cited

U.S. PATENT DOCUMENTS

| | | | |
|---|---|---|---|
| 228,282 | 6/1880 | Smith | 52/200 |
| 2,978,758 | 4/1961 | Dunn | 52/13 |
| 3,307,302 | 3/1967 | Gutierrez | 52/14 |
| 3,611,649 | 10/1971 | Muller | 52/14 |
| 3,735,596 | 5/1973 | Stephenson | 52/13 |

FOREIGN PATENT DOCUMENTS

| | | | |
|---|---|---|---|
| 1255896 | 12/1967 | Fed. Rep. of Germany | 52/11 |
| 1006488 | 10/1965 | United Kingdom | 52/200 |

*Primary Examiner*—John E. Murtagh

*Attorney, Agent, or Firm*—Shoemaker and Mattare, Ltd.

[57] ABSTRACT

A gutter system for skylights or the like which includes a formed or extruded primary gutter and a channel connector shop welded across the primary gutter at locations where a secondary gutter is desired. A secondary gutter is nested in the connector and is attached thereto. The channel connector has a drain hole defined therein for conducting water from the secondary gutter to the primary gutter.

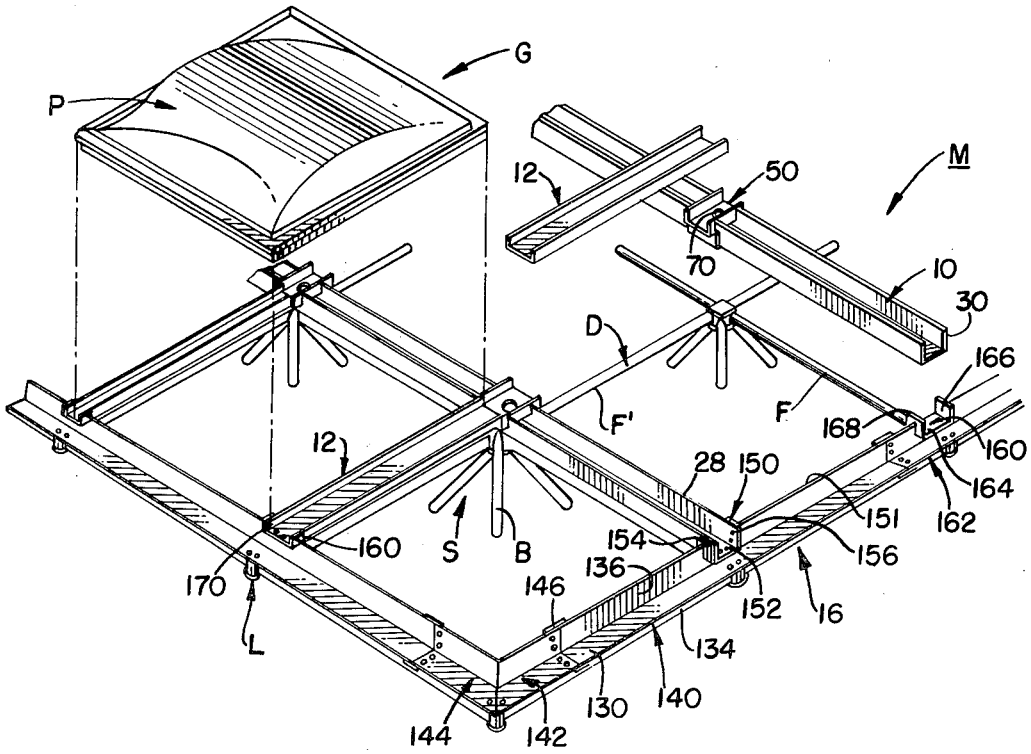

12 Claims, 7 Drawing Figures